United States Patent [19]

Blake

[11] 4,183,449

[45] Jan. 15, 1980

[54] MANUALLY OPERATED MINIATURE ATOMIZER

[75] Inventor: William S. Blake, Miami Lakes, Fla.

[73] Assignee: The AFA Corporation, Miami Lakes, Fla.

[21] Appl. No.: 868,084

[22] Filed: Jan. 9, 1978

[51] Int. Cl.[2] ..... B05B 9/04

[52] U.S. Cl. ..... 222/321; 222/340; 239/333; 417/547

[58] Field of Search ..... 222/321, 340, 380, 381, 222/382, 383, 384, 385; 239/331, 333; 417/547, 554, 562, 566

[56] References Cited

U.S. PATENT DOCUMENTS

| | | | |
|---|---|---|---|
| Re. 28,366 | 3/1975 | Pechstein | 239/333 |
| 3,779,464 | 12/1973 | Malone | 222/321 X |
| 3,865,313 | 2/1975 | Kondo | 222/383 X |
| 3,908,870 | 9/1975 | Nozawa et al. | 222/321 |
| 3,923,250 | 12/1975 | Boris | 222/321 X |
| 4,017,031 | 4/1977 | Kishi et al. | 222/321 X |
| 4,022,354 | 5/1977 | Kotuby | 222/321 |
| 4,051,983 | 10/1977 | Anderson | 239/333 X |
| 4,082,222 | 4/1978 | Boris | 222/385 X |

FOREIGN PATENT DOCUMENTS

| | | | |
|---|---|---|---|
| 2632662 | 1/1977 | Fed. Rep. of Germany | 239/333 |
| 2285815 | 5/1976 | France | 222/321 |

*Primary Examiner*—David A. Scherbel
*Assistant Examiner*—Fred A. Silverberg
*Attorney, Agent, or Firm*—Stanley A. Marcus; William R. Wright, Jr.

[57] ABSTRACT

A spray dispenser is presented which atomizes cosmetics, perfumes, and similar products to a state of fine spray throughout its entire spraying period. The pressure of the fluid product being sprayed is maintained by a spring loaded piston and a related valve which opens a passage to the spray outlet only after a predetermined spray pressure is reached and closes it when the pressure approaches a pressure insufficient to produce the fine spray.

14 Claims, 3 Drawing Figures

MANUALLY OPERATED MINIATURE ATOMIZER

BACKGROUND OF THE INVENTION

1. Field of the Invention

The present invention relates to a pressure controlled sprayer device, and more particularly, to a miniature atomizer of the manual type for atomizing to a state of fine spray cosmetic, perfume and similar products.

2. Description of the Prior Art

Pressure controlled sprayer devices including miniature atomizers of the manual type are known in the prior art. An example of such an atomizer is shown in U.S. Pat. No. 4,017,031, Kishi et al wherein vertically disposed axially aligned first and second cylinders of different diameters are formed in a communicating passage extending from a container holding the liquid product to be atomized to a nozzle outlet in the atomizer head, the lower cylinder being that having the smaller diameter. A tubular member having a connection to the atomizer head and extending between the cylinders includes a tubular piston on each end to provide a sliding seal with the associated cylinder. An inlet check valve is provided at the lower end of the smaller cylinder for controlling withdrawal of liquid from the container and a piston valve in the upper end of the larger cylinder controls the flow of liquid to the nozzle outlet. The inlet check valve and the piston valve thus form a pressure chamber between them. Actuation of the atomizer to force the tubular member down into the smaller cylinder, the return action being by way of a piston return coil spring member, boosts the pressure in the chamber to a predetermined level at which the piston valve opens to allow liquid to flow through the bore of the tubular member and out of the nozzle outlet. The liquid discharged is mixed with air at the nozzle outlet to form a fine mist.

In the action of such miniature atomizers it is imperative for the pressure in the chamber at which such discharge occurs to be independent of the finger force applied by the operator in depressing the atomizer head to the end that the discharge is a uniform mist, without dribble, particularly at the beginning and the end of each spray cycle. Such action is termed by the industry as non-throttling action, and is the desired mode of operation.

While the prior art miniature atomizers, as described, are considered non-throttling, they depend for uniformity of spray pattern upon a "specific combination" of function, that is, a relation of cylinder diameter ratios in combination with a single spring force in line with the two cylinders which has a direct bearing on the force used to actuate the atomizer. This is to say, the predetermined pressure at which the piston valve opens depends upon the force of the piston return spring which together with the internal pressure built up in the smaller cylinder determines the magnitude of finger force needed to depress the actuator for the tubular member. The magnitude of the force applied to the actuator accordingly is a variable that can alter the spray pattern and other such variables are nozzle outlet or orifice size and orifice land thickness. The prior art apparatus thus allows three variables to alter the spray pattern and break up for particle sizes.

Other disadvantages of the prior art miniature atomizers stem from the structural arrangements and the number of component parts required, some of which are very small and consequently difficult to handle, thereby making assembly difficult, and from the component parts configuration as affecting material cost, assembly and molding costs. By way of example, as the size of the atomizers have been scaled down, the return coil spring has become smaller and smaller to the extent that it is troublesome to handle both in storage and assembly, and moreover, its location in the smaller cylinder in contact with the product to be sprayed requires the use of special spring wire material that is inert to such product and which adds to the cost of materials required.

SUMMARY OF THE INVENTION

Among the objects of the present invention is the provision of a pressure controlled sprayer device embodying a minimum number of component parts that are inexpensive to manufacture and to assemble and which is independent in its operation of the finger force used to actuate the sprayer.

Another object is to provide such a pressure controlled sprayer device wherein a valve spring employed in conjunction with the piston valve provides a function independent of the action of the return spring of the device and of the finger force used to actuate the device, and which by selection of the diameter of the spring wire used to bias the piston valve allows the piston valve to function within several desired predetermined pressure values.

Another object of the invention is the provision for use in a pressure controlled sprayer device of a novel combination of uniquely configured component parts that facilitate molding thereof from a plastic material, for example, polyethylene, and ready assembly thereof in the device.

Another object of the invention is the provision of such a novel combination of component parts which provides for the return spring and piston spring members to be located out of the product or fluid to be sprayed.

Another object of the invention is the provision of a novel configuration of component parts that in the overall pressure controlled sprayer device permits a significant reduction in the numbers of individual parts that must be handled in the assembly of the device.

Another object of the invention is the provision of a novel seal combination which closes a vent to the container to prevent evaporation or leakage of the fluid product during periods when the sprayer is not in use but which automatically opens the vent upon the sprayer's operation.

Other objects and advantages of the present invention will become apparent from the discussion, detailed description and claims which follow in this application.

In accomplishing the above and other objects, the pressure controlled sprayer device of the present invention, in one aspect, embodies a sub-combination of two uniquely configured and integrally molded component parts each of which comprises a tubular member having first and second ends and with a piston formed on each of said ends. The tubular member of the first component part includes, additionally, first and second cylinders of different diameter or cross section formed on the second end thereof, the tubular piston on the first end of said second tubular member being inserted in and slideable in the said first cylinder, the latter having the smaller cross section.

In another aspect the novel combination of the present invention includes a pin shut-off valve element formed on the second end of the second tubular element, being integrally formed with said second member.

In another aspect, the novel combination of the present invention includes a third integrally molded component part that receives the two first mentioned component parts, and that defines third and fourth cylinders and also a closure-body for attachment of the pressure controlled sprayer device to a container of fluid product to be sprayed. The diameter or cross section of the third cylinder desirably is less than that of the second cylinder. The first and second ends of the first tubular member are inserted into and are slideable in said third and fourth cylinders, respectively. Resilient spring means external of the bores of the associated tubular pistons are provided for biasing the first tubular member to a predetermined extended position at which the interior chamber space, provided by the third cylinder and the bore of the first tubular member is at a maximum.

The pressure controlled sprayer device of the present invention further includes a non-return or check valve and a dip tube communicating through the non-return valve with the third cylinder for controlling the flow thereinto of product from a container and the containment therein of such product. The device further includes a nozzle and an attached actuating element and a valve seat with which the pin shut-off valve cooperates for controlling communication between the chamber formed by said first and third cylinders and the nozzle.

The pressure controlled sprayer device of the present invention further features the provision of a valve shut-off spring member external of the path of communication to the nozzle for acting on the piston connected to the pin shut-off valve element for interrupting or shutting off such communication. The valve shut-off spring member is characterized by providing, in effect, a fourth variable for altering the spray pattern, the other three being those mentioned in connection with the prior art devices. By changing diameter of the valve shut-off spring wire the piston valve may be made to operate within several predetermined pressure values.

The pressure controlled sprayer device of the present invention also features the provision of a sliding flexible seal associated with one of its movable members which seals against leakage or evaporation of the fluid product but which, upon full depression of the cap, uncovers a groove or recess located in the wall of the fourth cylinder in the seal's path to open a path to the vent passage from the atmosphere. This vent passage may be a hole as shown in FIG. 3 or could be a groove or other opening.

DETAILED DESCRIPTION OF THE INVENTION

Figure 1:
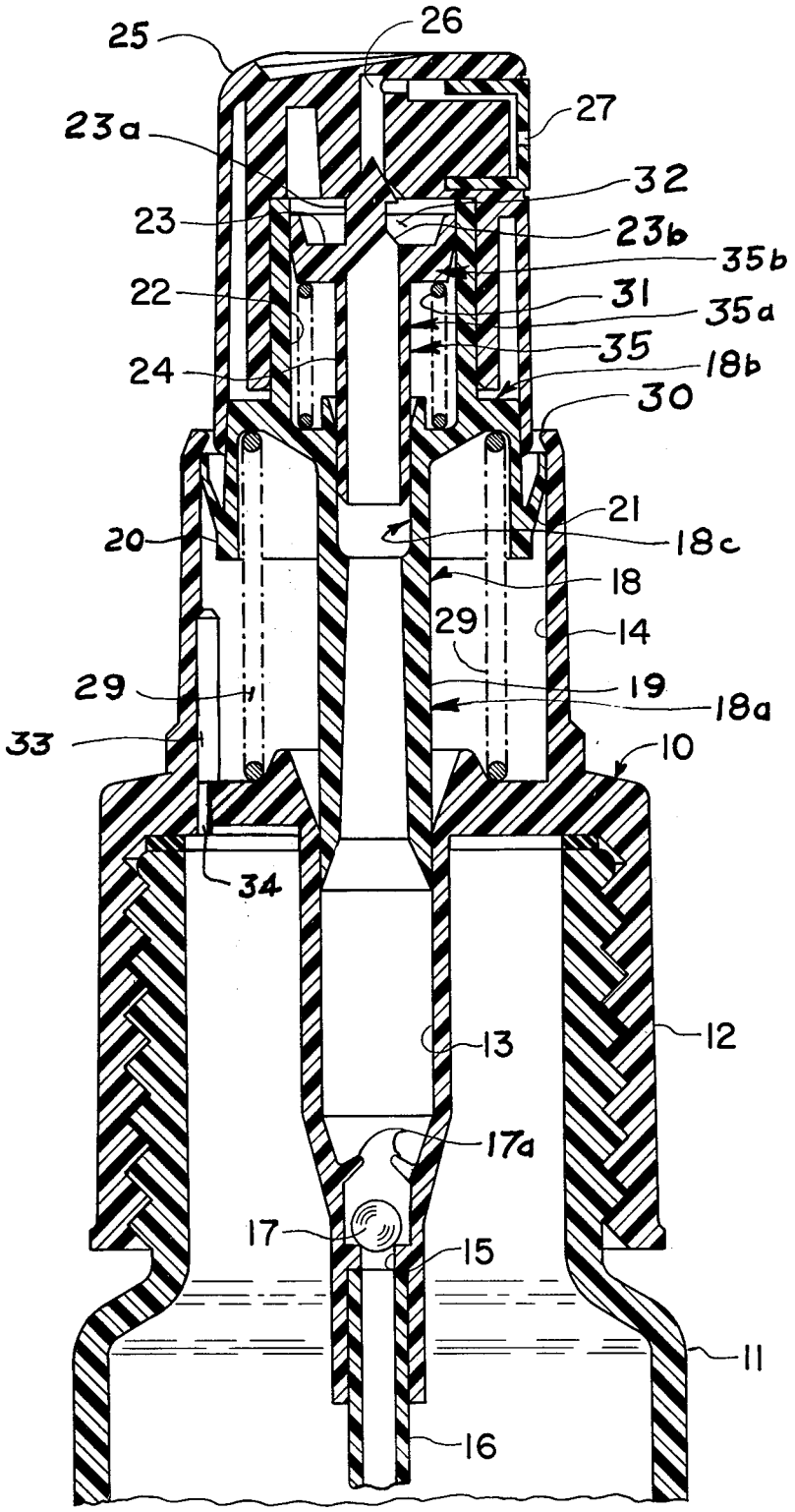
FIG. 1 is a cross sectional view of the sprayer in its original or initial ready-to-operate condition.

As mentioned earlier in this specification, the pressure controlled sprayer device of the present invention, in one aspect, embodies a sub-combination of two uniquely configured component parts each of which is integrally molded or unitary. The first of these components with reference to FIG. 1 of the drawings, is the first tubular member 18 and it has a first end 18*a* with a first tubular piston 19 formed on it, and, a second end 18*b* with a skirted second tubular piston 20 formed on it. In addition, member 18 has a first cylinder 18*c* formed within the upper portion of piston 19 and a second cylinder 22 formed atop second end 18*b* and upstanding therefrom. The second of the components is the second tubular member 35 and it has a first end 35*a* with a third tubular piston 24 formed on it, and, a second end 35*b* with a fourth tubular piston 23 formed on it. Additionally, a pin shut-off valve element 23*a* is formed integrally atop second end 35*b*.

Also as mentioned previously, in another aspect, the novel combination of the present invention includes a third integrally molded component part that receives the aforementioned two components. This third component 10 comprises a closure-body or screw cap portion 12 which is adapted for attachment to a fluid product container, an internal bore or third cylinder 13 and a second bore or fourth cylinder 14 concentric with third cylinder 13 but extending upwardly therefrom in the manner shown. The lower end of third cylinder 13 includes a valve seat 15 which, when the valve is open, communicates with a dip tube or straw 16 extended downwardly into container 11. A ball 17 is located on valve seat 15 and is loosely retained in place there by integrally molded individual and separated retainer fingers 17*a* so that ball 17 can move upwardly away from seat 15 under the influence of a vacuum or suction as will be explained later and thus afford communication between and around both the ball and the fingers 17*a* from the dip tube 16 into bore 13. The ball 17 and its valve seat 15, form a check or non-return valve with fingers 17*a* keeping the ball from moving away from seat 15 more than is necessary to allow flow.

As will be seen in FIG. 1, the first tubular piston 19 extends downwardly into third cylinder 13 and is closely fitted but easily slidable therein. The lower end of piston 19 is chamfered on its inner surface as shown to provide a fluid pressure seal against the third cylinder 13 as air or fluid product pressure forces the thinner section at the chamfer against the cylindrical wall. Also, second tubular piston 20 extends downwardly into fourth cylinder 14 with the skirt 21 pushing outwardly against the interior wall of fourth cylinder 14 in fluid product sealing relationship thereto but also permitting easy sliding. The skirt 21 is of an annular inverted chevron type molded integrally with piston 20 as shown but by virtue of the flexible qualities of the material has sufficient resiliency to effect the necessary outward push against cylinder 14.

The fourth piston 23 formed on the second end 35*b* of second tubular member 35 is in the shape of an inverted cup seal and is located within second cylinder 22 in slidable, fluid product sealing relationship thereto. An open passage or port 23*b* is provided through piston 23 as shown.

Figure 2:
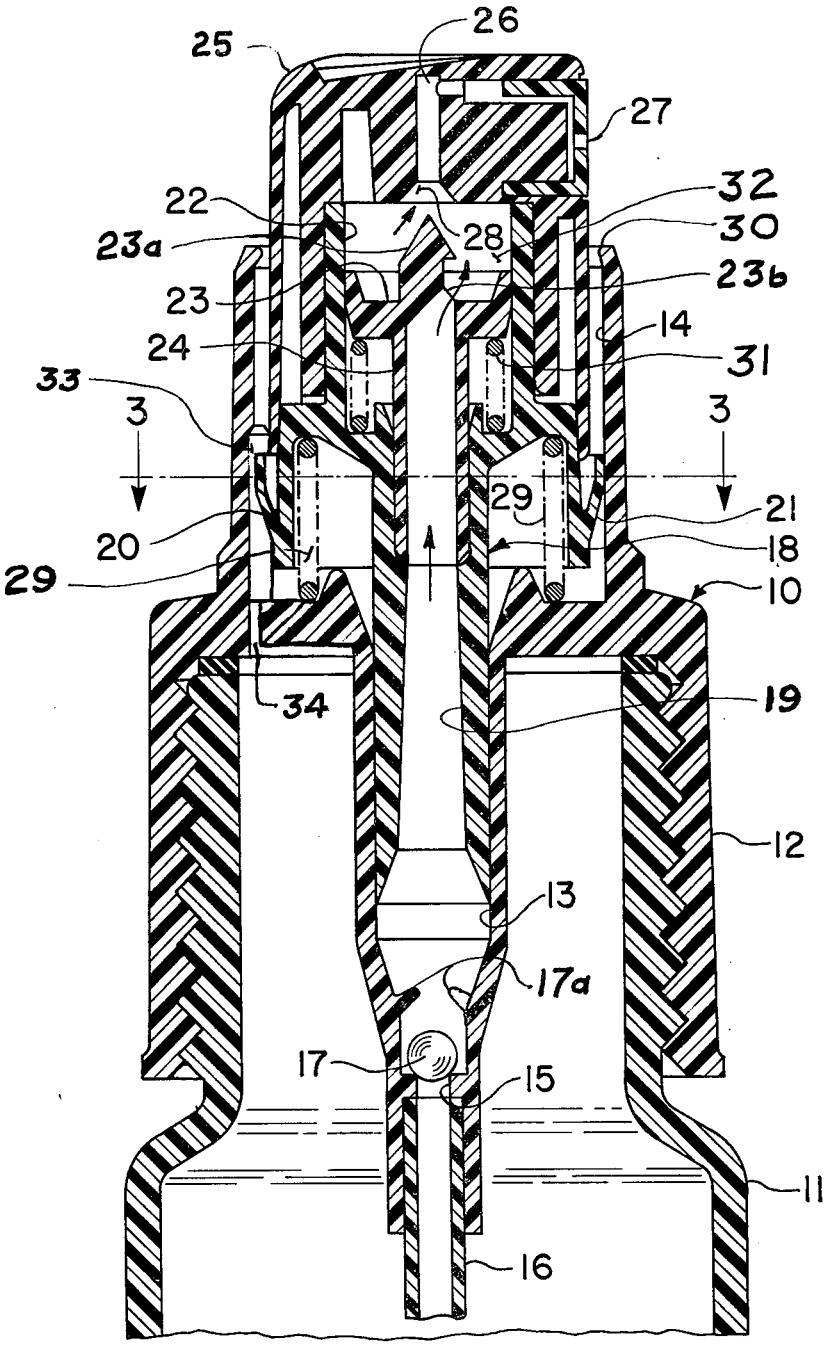
FIG. 2 is a cross sectional view of the sprayer with its actuator depressed and with spraying taking place; and, FIG. 3 is a cross sectional view of the sprayer with its actuator depressed and with the view taken in the direction of the arrows 3—3.

The lower end of third tubular piston 24 is of less area than that of fourth piston 23 as will be seen in FIGS. 1 and 2 so that the pressure forces exerted on the larger area will be in excess of that of the smaller as will be explained later. Atop second end 35*b* of second tubular member 35 and extended upwardly therefrom is conically-shaped pintle or pin shut-off valve element 23*a* which is substantially axially aligned with valve seat 28, and which will mate with the seat 28 to effect a fluid product sealing relationship therewith when the fourth piston 23 is moved upward as far as it can move. Piston 23 and pintle 23*a* are unitary in construction preferably being molded in one piece as previously mentioned.

The upper end of second cylinder 22 is closed by a skirted cap or actuator 25 which surrounds cylinder 22 in fluid product sealing relationship to it as shown and has a fluid product conduit passage 26 within it leading to an outlet or nozzle 27. The passage 26 has a chamfered or bevelled frusto-conical entrance 28 (numeral 28 omitted from FIG. 1 for clarity) which serves as valve seat 28.

Referring again to second tubular piston 20, a resilient member in the form of a helical spring 29 is interposed between its underside and the top of screw cap 12 in the manner shown in FIG. 1 with spring 29 installed under a slight compression sufficient to hold piston 20 up in the "at rest" position as shown with the upper edge of its chevron sealing flange 21 bearing against inwardly curved annular lip 30 which restrains any further upward motion. Another resilient member in the form of a helical spring 31 is located between second end 18*b* of first tubular member 18 and fourth tubular piston 23 and is installed under a slight compression so that piston 23 is urged upward by it until pintle 23*a* is seated on seat 28 as indicated in FIG. 1, thus preventing further upward travel of piston 23.

It is preferred that the entire spray dispenser, with the possible exception of the springs which may be made of metal spring wire, and the ball which may also be made of metal, be molded of a plastic material such as polypropylene or polyethylene which have a desirable degree of resiliency as needed in the various fluid product sealing parts and for the flexible chevron type seal 21 on the skirt of piston 20. In addition, these materials provide good dimensional stability necessary to keep sliding parts from jamming or sticking and provide good moldability and other desirable qualities such as compatibility with the fluid product. Other materials can also be used provided that they have the needed attributes and qualities just mentioned.

OPERATION OF THE INVENTION AND FURTHER DESCRIPTION

Figure 3:
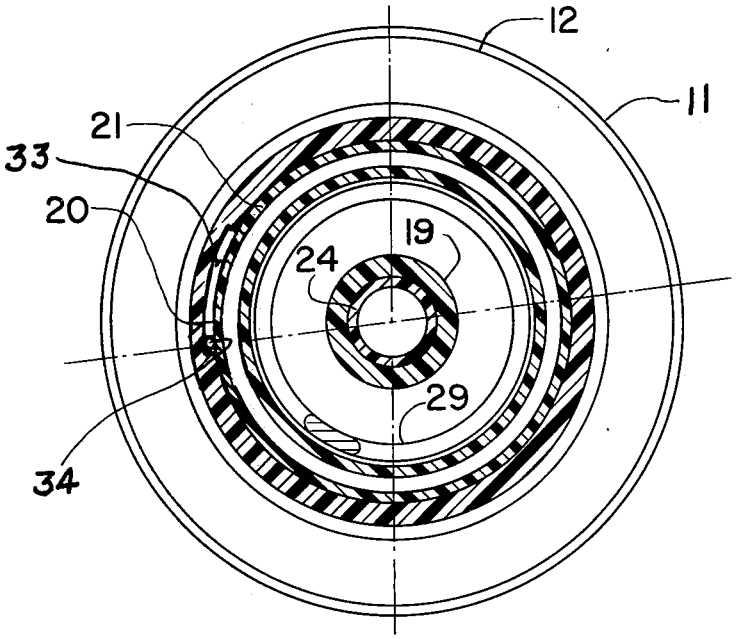

The container is first filled with the fluid product to be dispensed and the screw cap 12 is then screwed in place on its top with dip tube 16 extended downwardly into the fluid product, the level of which would be below the ball check valve seat 15. The sprayer is then in the condition shown in FIG. 1 with the first tubular piston 19 and fourth piston 23 in their fully upward position and with pintle 23*a* on seat 28 and urged against it by springs 29, 31 in fluid product sealing relationship thereto and with the skirt seal 21 of first tubular piston 19 fully extended against bore 14 throughout its entire periphery. The actuator 25 is then pushed downward by the thumb of the user until spring 29 is compressed and until second tubular piston 20 "bottoms out" by striking against screw cap 12 as shown in FIG. 2. As first tubular member 18 moves downwardly, the annular skirted seal 21 on second tubular piston 20 uncovers recess or groove 33 in the inner wall of fourth cylinder 14 as shown in FIGS. 2 and 3 thus opening a vent path from the atmosphere down past deflected seal 21 and through open vent hole or passage 34, and then into container 11 where the atmosphere exerts its pressure on the fluid product contained therein. Meanwhile, the first tubular piston 19 moves downwardly in third cylinder 13 slightly compressing the air in its hollow interior and forcing ball 17 onto its seat 15 and thus blocking any flow of air back into the container 11. A portion of this air is also forced up through passage 23*b* into chamber 32 in second cylinder 22 above fourth piston 23 where it exerts pressure upon piston 23 greater than the pressure upon the lower end of third tubular piston 24 and greater than the force of spring 31 and thus forces it down causing pintle 23*a* to move away from seat 28 and thus affording communication into passage 26 and allowing passage of the air out through outlet 27. The actuator 25 is then allowed to return to its normal upward position as in FIG. 1 under the urging of spring 29, and, as first tubular member 18 also moves upward, a partial vacuum or suction occurs in its interior causing ball 17 to be moved off its seat 15 and permitting some fluid product from the container to be sucked up into it from container 11 through dip tube 16, past seat 15 and past ball 17. This action is repeated until the fluid product flows upwardly into chamber 32 which it fills exerting pressure on piston 23. This action is called "priming". When this pressure force exceeds that needed to overcome the spring 31 and the pressure force on the lower end of third tubular piston 24, fourth piston 23 moves downward opening valve 23*a*, 28 and allowing pressurized fluid product to flow up through passage 26 and thus to pass through outlet 27 as a spray. When the pressure differential on third tubular piston 23 becomes sufficiently less than the force of the compressed spring 31, the piston 23 is forced upward by spring 31 closing valve 23*a*, 28 and thus cutting off the flow through the outlet 27. It is important to note that spring 31 is sufficiently strong in predetermined compressive force that a fluid product pressure sufficient to produce a fine spray out of outlet 27 must be present in chamber 32 or else fourth piston 23 will move upward and close valve 23*a*, 28 to shut-off flow through outlet 27. Because of this, only a finely divided spray is produced through outlet 27 and dribbling or a spurting effect are eliminated since any "throttling" effect will take place only during the slight pressure drop from the third tubular piston 23 original downward movement pressure to that of the final cut off pressure with the cut off pressure still remaining not less than the amount needed to produce a good spray. The device, therefore, is essentially "non-throttling" in its operation.

The actuator 25 can be depressed repeatedly to continue the production of a spray until the fluid product in container 11 becomes exhausted.

It is also important to note that no matter how fast or how slowly a user depresses the actuator 25, or how many times he does so after the sprayer is primed, the spray will be of a constant good quality since it is entirely independent of the rate of movement of the actuator 25.

The spray dispenser can be used with a variety of fluid products such as perfumes, hair sprays, oral astringents, deodorants and the like provided that they are not so viscous or adhesive as to cause clogging or sticking of the parts, are compatible with the materials used in the construction of the dispenser and will not separate to any substantial degree while resting in the container.

It is a feature of the invention that both springs 29 and 31 are never in contact with the fluid product itself, and, since they are ordinarily made of metal, corrosion of the springs by the fluid product or contamination of the fluid product therefrom are therefore prevented. Also, the springs do not interfere with the flow of fluid product nor take up space which is instead filled more usefully with the fluid product.

While there have been shown and described and pointed out the fundamental novel features of the invention as applied to a preferred embodiment, it will be understood that various omissions and substitutions and changes in the form and details of the device illustrated and in its operation may be made by those skilled in the art, without departing from the spirit of the invention. It is the intention, therefore to be limited only as indicated by the scope of the following claims.

What is claimed is:

1. Pressure controlled sprayer apparatus comprising:
a container for dispensing fluid;
a dispensing outlet;
component means comprising a closure body connected to the container, a downwardly disposed third cylinder, vent means, and a valve seat in the lower end of the third cylinder wherein check valve means is loosely retained in place in the lower end of the third cylinder;
a dip tube extending into the container and connected to the third cylinder;
and further comprising first and second tubular members, said first member having first and second ends with a first tubular piston formed on said first end and first and second cylinders of different cross section formed on said second end, said second member having first and second ends with a third tubular piston and a fourth piston formed, respectively, on said first and second ends, said third tubular piston being inserted in and slidable in said first cylinder, said first tubular piston being slidable in said third cylinder;
a second tubular piston formed on the second end of said first tubular piston and being slidable in said fourth cylinder;
actuator means for actuating the first and second tubular members so as to dispense the fluid from the container through the dispensing outlet, valve means associated with said third cylinder and with said third tubular piston and providing a variable volume chamber including portions at least of said second and third cylinders and the interior space of said first and second tubular members, and resilient means biasing said first tubular piston to a predetermined position in said third cylinder, said predetermined position providing substantially maximum volume of said chamber.

2. Apparatus as specified in claim 1 wherein said second tubular member has formed on said second end thereof a pin shut-off valve element.

3. Apparatus as specified in claim 2 wherein said second tubular member, said third and fourth pistons, and said pin shut-off valve element are formed as a unitary molding.

4. Apparatus as specified in claim 3 wherein said first tubular member, said first tubular piston, and said first and second cylinders are formed as a unitary molding.

5. Apparatus as specified in claim 1 wherein said first tubular member, said first tubular piston, and said first and second cylinders are formed as a unitary molding.

6. Apparatus as specified in claim 1 wherein said first tubular member includes a second tubular piston formed on said second end thereof.

7. Apparatus as specified in claim 1 wherein said unitary molding includes as an integral part thereof said second tubular piston.

8. Apparatus as specified in claim 1 wherein said means defining said third and fourth cylinders comprises a unitary molding.

9. Apparatus as specified in claim 1 including resilient means biasing said second tubular piston in a direction to increase the volume of the space enclosed by said third cylinder and the internal space of said first tubular member.

10. Apparatus as specified in claim 1 including valve means for controlling communication between the interior of said third cylinder and said nozzle, said valve means including a pin shut-off valve element connected to said fourth tubular piston, and resilient means acting on said fourth tubular piston to interrupt such communication.

11. Apparatus as specified in claim 10 wherein said first tubular member with said first and second tubular pistons and said first and second cylinders formed thereon, said second tubular member with said third and fourth tubular pistons and said pin shut-off valve element formed thereon, and said means defining said third and fourth cylinders are each formed as a unitary molding.

12. Apparatus as specified in claim 10 wherein said resilient means acting on said fourth tubular piston comprises a wire spring, the diameter of said wire being selected as required for said pin shut-off valve element to open to establish communication between said third cylinder and said nozzle at a desired predetermined pressure value within said enclosed space.

13. Apparatus as specified in claim 10 wherein said resilient means biasing said second tubular piston and said resilient means acting on said fourth tubular piston are both arranged externally of the communication between the interior of said third cylinder and said nozzle.

14. Apparatus as specified in claim 1 wherein said vent means for the container includes an opening in said closure body providing communication with said fourth cylinder and an interrupted wall area in said fourth cylinder arranged in cooperative relation with said second tubular piston.

* * * * *